US006011856A

United States Patent [19]

Kigawa et al.

[11] Patent Number: 6,011,856

[45] Date of Patent: Jan. 4, 2000

[54] ELECTROACOUSTIC TRANSDUCER AND ELECTRONIC EQUIPMENT USING THE SAME

[75] Inventors: Naoyuki Kigawa; Takahiro Sone; Yoshio Imahori, all of Shizuoka, Japan

[73] Assignee: Star Micronics Co., Ltd., Shizuoka, Japan

[21] Appl. No.: 08/943,107

[22] Filed: Oct. 6, 1997

Related U.S. Application Data

[62] Division of application No. 08/534,293, Sep. 27, 1995, abandoned.

[30] Foreign Application Priority Data

Oct. 3, 1994 [JP] Japan ..... 6-264514

[51] Int. Cl.[7] ..... H04R 25/00

[52] U.S. Cl. ..... 381/410; 381/400; 29/594

[58] Field of Search ..... 381/190, 191, 381/192, 193, 194, 195, 173, 174, 176, 400, 410, 412, 420, 417; 29/594, 609.1, 840

[56] References Cited

U.S. PATENT DOCUMENTS

| | | | |
|---|---|---|---|
| 4,048,713 | 9/1977 | Hvass | 29/594 |
| 4,504,703 | 3/1985 | Schneiter et al. | 381/191 |
| 5,091,028 | 2/1992 | Yamazaki et al. | 381/194 |
| 5,432,758 | 7/1995 | Sone | 381/398 |

*Primary Examiner*—Huyen Le
*Attorney, Agent, or Firm*—Pollock, Vande Sande & Amernick

[57] ABSTRACT

The present invention provides an electroacoustic transducer which realizes an optimum characteristic thereof utilizing heat caused by reflow soldering without being influenced by the same heat. The electroacoustic transducer includes a magnetic driving portion composed of a base, a core provided upright on the base and a coil wound around the core, wherein a height of the coil at the manufacturing time is set lower by a height which corresponds to thermal expansion of the coil in reflow soldering, and a projection length of the core exposed from the coil at the manufacturing time is set larger by the height which corresponds to thermal expansion of the coil in reflow soldering.

4 Claims, 9 Drawing Sheets

ELECTROACOUSTIC TRANSDUCER AND ELECTRONIC EQUIPMENT USING THE SAME

This application is a divisional of U.S. patent application Ser. No. 08/534,293, filed Sep. 27, 1995 now abandoned.

BACKGROUND OF THE INVENTION

1. Field of the Invention

The present invention relates to an electroacoustic transducer adapted for reflow soldering and an electronic equipment using the same.

2. Description of the Prior Art

Conventionally, an electroacoustic transducer is mounted in a small-sized electronic equipment such as a portable telephone, a pager unit as a notification means. The electroacoustic transducer mounted in such electronic equipment is small-sized in itself, and constituting parts thereof are miniaturized. Further, electric connections of the electroacoustic transducer with the electronic equipment is performed by reflow soldering. The reflow soldering is a method to permit portions to be joined together to pass through heated and fused solder so as to solder the same. Reflow temperature is high to the extent of about 300° C. and reflow heat is also applied to a portion other than the portions to be joined, particularly a coil of a magnetic driving portion of the electroacoustic transducer is exposed to heat generated by the reflow soldering.

Whereupon, there are a bobbin type coil and a bobbinless type coil as the form of the coil installed in the magnetic driving portion. In the electroacoustic transducer which is needed to be small-sized, employment of the bobbinless type coil is dominating. This is caused by the fact that a space to be occupied by the coil in the electroacoustic transducer is narrowed. It is necessary to increase the ratio of space occupied by the coil itself so as to assure sufficient number of windings of the coil in the narrow space. The bobbinless type coil is realized also by the employment of a fusion type wire for forming the coil.

Whereupon, when the reflow soldering is performed on the electroacoustic transducer, heat generated by the reflow soldering deforms the coil, especially increases the height of the coil. As a result, it influences upon not only the shape thereof but acoustic characteristic so as to deteriorate the acoustic characteristic such as change of generated sound, whereby the quality of final product is likely to be deteriorated. Accordingly, the bobbin type coil is forced to be used. Further, it is necessary to take a measure to perform the soldering at a reflow temperature as low as possible.

SUMMARY OF THE INVENTION

Accordingly, it is an object of the present invention to provide an electroacoustic transducer and an electronic equipment using the same capable of performing its optimum characteristic utilizing heat generated during the reflow soldering without being influenced by the same heat.

The electroacoustic transducer includes a magnetic driving portion (10) composed of a base (20), a core (22) provided upright on the base (20) and a coil (24) wound around the core (22) as shown in FIGS. 1 and 2, wherein it is characterized in that a height of the coil 24 at the manufacturing time is set lower by a height which corresponds to thermal expansion of the coil at the reflow soldering time.

The coil heated during the reflow soldering is expanded so that its height is changed to thereby change the characteristic of the electroacoustic transducer, particularly deteriorate its acoustic characteristic.

According to the electroacoustic transducer of the present invention, since the reflow temperature and time involved in the reflow soldering are substantially constant, the size (height) of the coil expanded at the reflow soldering can be recognized precisely. Accordingly, the height of the coil of the electroacoustic transducer of the present invention at the manufacturing time is set to be low by the expansion height of the coil. As a result, when the coil is heated during it is subjected to the reflow soldering, the height of the coil is transferred (optimized) to an optimum height due to the expansion of the coil, so that the characteristic of the electroacoustic transducer is improved by the heat caused by the reflow soldering compared with that at the manufacturing time. In other words, the electroacoustic transducer being as a semi-final product in the characteristic thereof at the manufacturing time is changed to an optimum final product by reflow soldering.

Even if the electroacoustic transducer is in an optimum form or state at the manufacturing time, the acoustic characteristic thereof is changed due to the reflow soldering when it is mounted in the electronic equipment, so that a desired characteristic can not be obtained, which does not achieve the purpose of the product. However, according to the electroacoustic transducer of the present invention, it receives heat caused by the reflow soldering so as to obtain an optimum characteristic, which contributes to the electronic equipment as the final product more than expected.

Further, the electroacoustic transducer includes a magnetic driving portion (10) composed of a base (20) and a core (22) provided upright on the base (20), a coil (24) wound around the core (22) as shown in FIGS. 1 and 2, wherein it is characterized in that a projecting length (H1) of the core (22) exposed from the coil (24) at the manufacturing time is set larger by a height which corresponds to thermal expansion of the coil at the reflow soldering time.

That is, in the electroacoustic transducer according to the present invention, even if the length of the core projecting from the coil is set larger by the expansion height, an optimum characteristic can be obtained after the coil is subjected to the reflow soldering.

DETAILED DESCRIPTION OF THE PREFERRED EMBODIMENT

An electroacoustic transducer according to a preferred embodiment of the present invention will be now described with reference to attached drawings.

Figure 1:
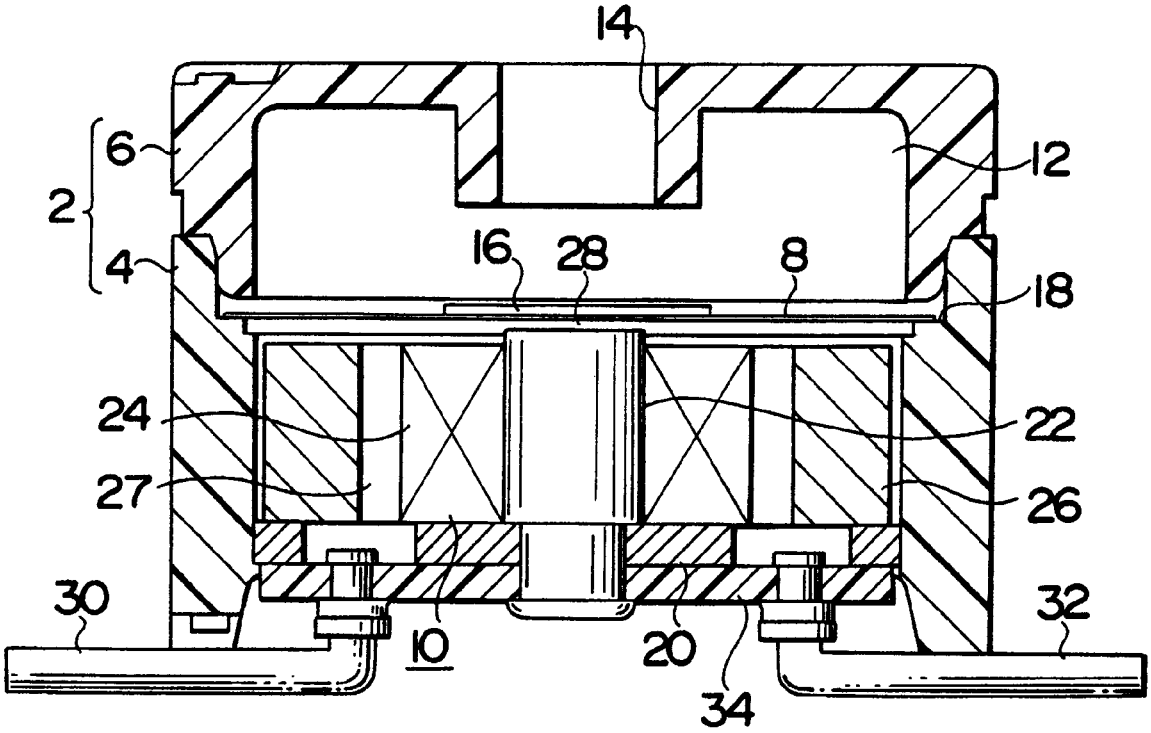
FIG. 1 is a longitudinal cross-sectional view of an electroacoustic transducer according to a preferred embodiment of the present invention.

FIG. 1 is a longitudinal cross-sectional view of the electroacoustic transducer of the present invention. In the electroacoustic transducer, an outer casing 2 formed of a molded body made of synthetic resin comprises a cylindrical body case 4 and a bowl-shaped cover case 6 joined to the body case 4. The outer casing 2 houses a diaphragm 8 and a magnetic driving portion 10, and a resonant chamber 12 formed on the upper side of the diaphragm 8. A cylindrical sound emitting hole 14 is provided on the cover case 6 at the center thereof and projects toward an inner side of the cover case 6. The sound emitting hole 14 confronts a central portion of the diaphragm 8 and receives oscillation from the diaphragm 8 and emits resonance sound to the atmosphere.

The diaphragm 8 is a discoidal plate made of magnetic material and has a magnetic piece 16 which is fixed to the center thereof for increasing mass. The diaphragm 8 is disposed on a stepped portion 18 formed in the body case 4, wherein end surface portions of the cover case 6 confront the stepped portion 18 with a given interval therebetween so as to prevent the diaphragm 8 from coming off the stepped portion 18.

The magnetic driving portion 10 is a driving source for magnetically oscillating the diaphragm 8. The magnetic driving portion 10 comprises a base 20 as a substrate member, and it is a discoidal plate made of magnetic material. A columnar core 22 is provided upright on the center of the base 20, and a coil 24 is disposed around the core 22. An annular magnet 26 which is concentric with the coil 24 is disposed around the coil 24 with a space 27 being defined between the outer periphery of the coil 24 and the annular magnet 26.

A given gap 28 is defined between the top portion of the core 22 and the diaphragm 8. The gap 28 defines a space for allowing the diaphragm 8 to oscillate therein. The base 20, the core 22, the diaphragm 8 and the annular magnet 26 form a closed magnetic path through the gap 28. Magnetic force of the annular magnet 26 acts upon the closed magnetic path as a bias magnetic field, wherein the diaphragm 8 is attracted toward the annular magnet 26 so that the diaphragm 8 is fixed to the stepped portion 18 of the body case 4. An alternating magnetic field is generated in the coil 24 by an ac input signal which is applied thereto through terminals 30 and 32, so that the diaphragm 8 is oscillated in the forward or backward direction of the gap 28 due to the interaction between the alternating magnetic field and the bias magnetic field, and the oscillation of the diaphragm 8 depends on the frequency of the ac input signal applied to the terminals 30 and 32. As a result of the oscillation, acoustic sound is generated in the resonant chamber 12 and it is emitted through the sound emitting hole 14.

The terminals 30 and 32 each being rod-shaped are penetrated through a board 34 provided on the back side of the outer casing 2, and fixed thereto at the end portions thereof by caulking or soldering. Distal ends, not shown, of the coil 24 are electrically connected to the terminals 30 and 32 by a means such as soldering. Each of the terminals 30 and 32 is electrically connected to a conductive pattern on a wiring board of an electronic equipment, not shown, by soldering, wherein the connection therebetween is performed by reflow soldering.

Figure 2:
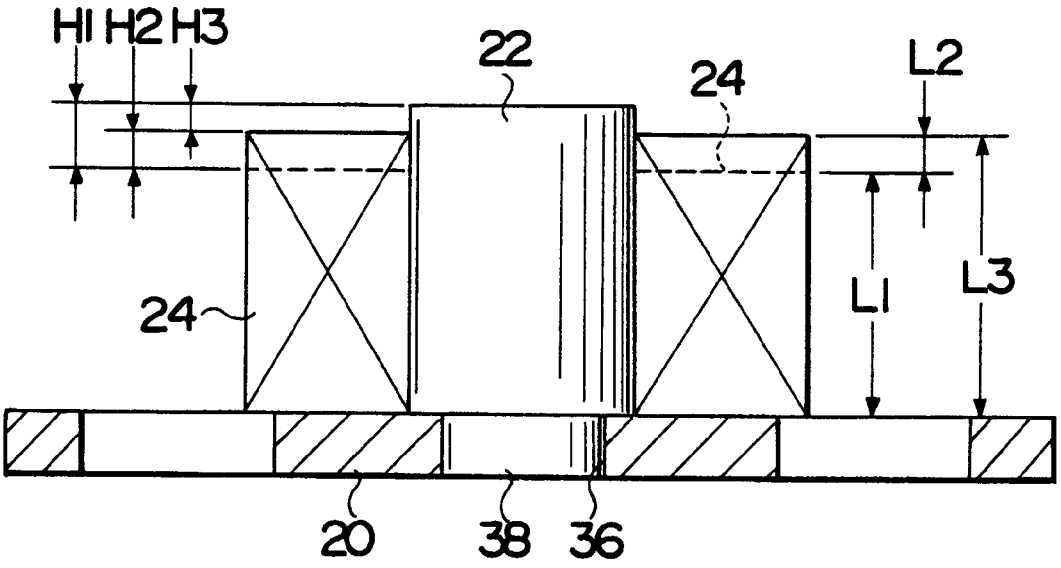
FIG. 2 is an enlarged cross-sectional view of a structure of a pole piece portion.

The columnar core 22 is provided upright on the base 20 to constitute a pole piece portion as shown in FIG. 2. That is, a fixing hole 36 diameter of which is smaller than that of the body portion of the core 22 is formed on the center of the base 20, wherein a small diameter portion 38 of the core 22 is pressed into the fixing hole 36, so that a central axis of the core 22 crosses at right angles with the base 20. In this embodiment, although the core 22 is pressed into the base 20, the base 20 and the core 22 are not always fixed to each other in this way. The base 20 and the core 22 can be formed of a single member, for example, a metallic plate forming the base 20 is subjected to a molding process so as to project the core 22 therefrom. Even if the base 20 and the core 22 are formed of separate members, they can be joined to each other by welding. In any case, so long as the base 20 and the core 22 are magnetically coupled to each other, any coupling manner may be taken.

As a manner for winding the coil 24 to the core 22, there are such methods that the coil 24 is directly wound around the core 22 or the previously cylindrically wound coil 24 is fit onto the core 22. Supposing that a height of the coil 24 at the manufacturing time is L1 (manufacture height), a height of thermal expansion of the coil 24 by reflow soldering is L2 (expansion height), and an optimum height of the coil 24 when the electroacoustic transducer is mounted in the electronic equipment is L3 (final height), the manufacture height L1 meets an equation of $L1=L3-L2$, which is obtained by subtracting the expansion height L2 from the final height L3.

If the relationship between the heights of the coil 24 are viewed from the core 22 side, supposing that a projecting length of the core 22 from the coil 24 at the manufacturing time is H1 (manufacture projecting length), a height of thermal expansion of the coil 24 by reflow soldering is H2 (expansion height), and an optimum projecting length of the core 22 when the electroacoustic transducer is mounted in the electronic equipment is H3 (final projecting length), the manufacture projecting length H1 meets an equation of $H1=H2+H3$, and H1 forms a difference in level between the core 22 and the coil 24.

Described next is a method of forming the coil 24 having the coil height L1. In a first method, supposing that the height of the prior art coil 24 is L3 for convenience of comparison, the height L1 of the coil 24 is set by reducing the number of windings compared with that of the prior art coil having the height L3. In a second method, a diameter of wire forming the coil 24 is reduced while the number of winding of the wire is the same as that of the prior art coil.

Figure 3:
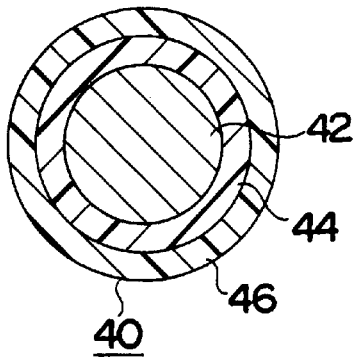
FIG. 3 is a cross-sectional view of a wire forming a coil.

FIG. 3 shows a wire 40 forming the coil 24. A fusing wire or solvent fixing wire such as a thermal fusion magnet wire or the like is employed as the wire 40. That is, the wire 40 comprises a conductor 42 which is made of copper, etc. and circular in cross section, an insulating film 44 which is made of polyurethane, etc. and disposed around the conductor 42, and a fusing film 46 which is made of thermal plastics resin such as poliamide, etc. and disposed around the insulating film 44.

Figure 4:
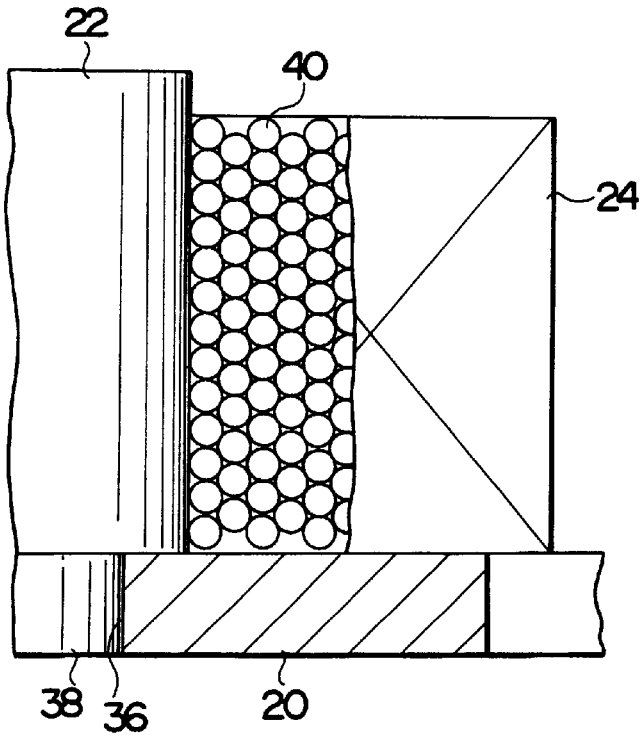
FIG. 4 is an enlarged cross-sectional view showing a winding manner of the coil.

FIG. 4 shows an embodiment of the coil 24. The coil 24 is of multiplex winding type. Since the fusing film 46 is formed on the surface of the wire 40, the coil 24 formed by the thermal fusing wire can be fused and cured by heating while it is wound. The coil 24 formed by the solvent fixing wire can be dissolved and cured by solvent such as alcohol while it is wound. Accordingly, the coil 24 can be cured after it is wound around the core 22, or a separately wound and cured coil 24 can be mounted on and fit onto the core 22.

The electroacoustic transducer having such an arrangement is shipped as a product and mounted in the electronic equipment such as a portable telephone, wherein the electric connection between the electroacoustic transducer and the electronic equipment is performed by reflow soldering. In this case, the coil 24 housed in the electroacoustic transducer is heated by reflow temperature so as to generate thermal expansion.

Figure 5:
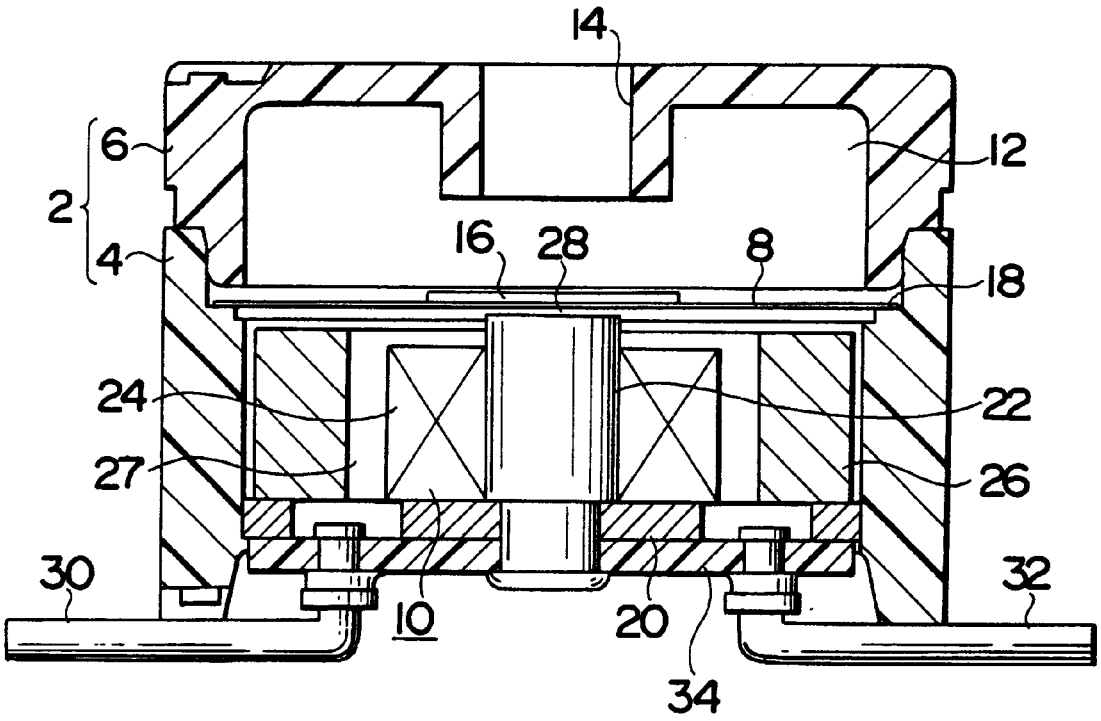
FIG. 5 is a longitudinal cross-sectional view of an electroacoustic transducer according to the preferred embodiment of the present invention.
Figure 6:
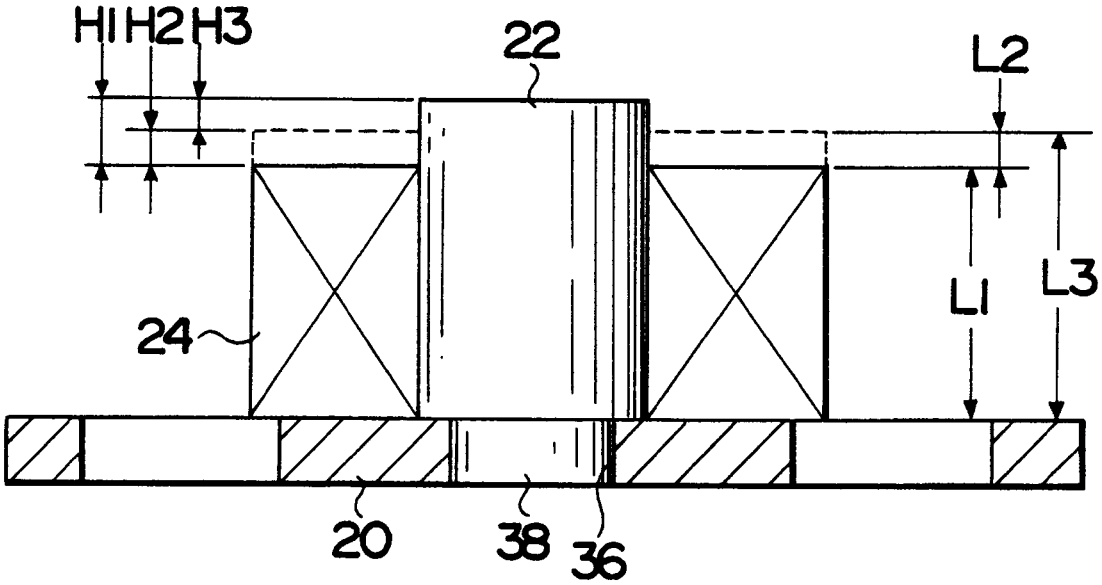
FIG. 6 is an enlarged cross-sectional view of a structure of a pole piece portion in a state where a coil is expanded.
Figure 7A:
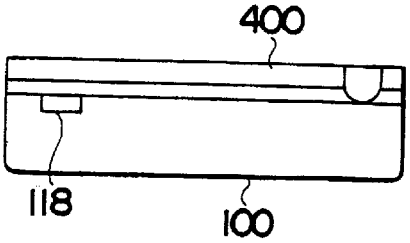
FIG. 7A is a plan view of an upper case of a portable telephone.
Figure 7B:
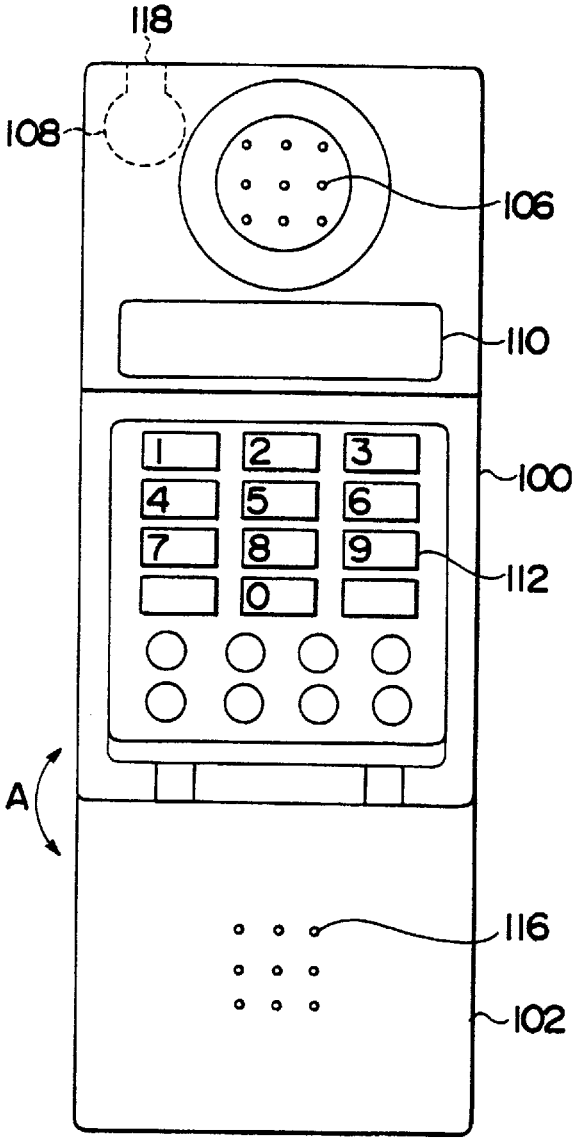
FIG. 7B is a front view of the upper case of the portable telephone.
Figure 7C:
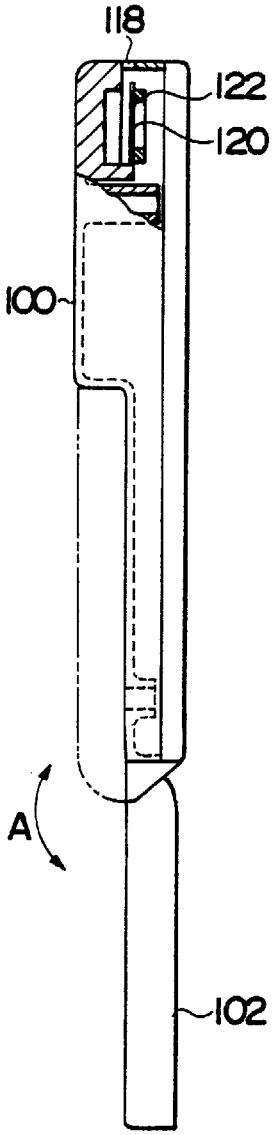
FIG. 7C is a side view of the upper case of the portable telephone.
Figure 7D:
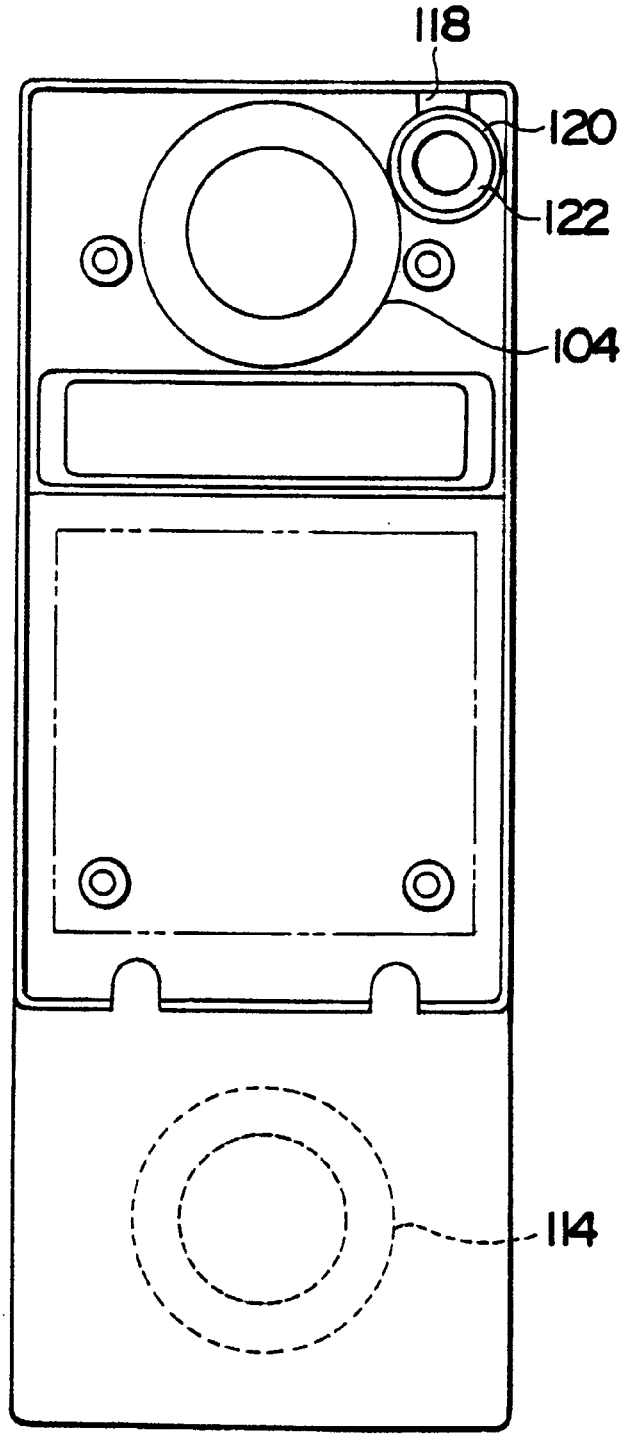
FIG. 7D is a bottom view of the upper case of the portable telephone.

As a result of thermal expansion, the coil 24 of the magnetic driving portion 10 is extended in an axial direction as shown in FIG. 5, and the manufacture height L1 of the coil 24 is changed to the final height L3 by addition of the expansion height L2 as shown in FIG. 6. Consequently, the projecting length H1 of the core 22 is subtracted by the expansion height H2 due to the thermal expansion of the coil 24, and it is changed to the optimum final projecting length H3.

A summary of the portable telephone employing the electroacoustic transducer will be now described. FIGS. 7A to 7D, FIGS. 8A and 8B and FIGS. 9A and 9B show examples of the portable telephone.

As shown in FIGS. 7A to 7D, the portable telephone includes a movable case portion 102 which is attached to an upper side case portion 100 formed of a molded body made of synthetic resin by a hinge mechanism, the movable case portion being foldable in the direction of an arrow A. A sound emitting hole 106 is formed on the upper side case portion 100 for a receiver 104 provided inside the upper side case portion 100. A space 108 is formed on the upper side case portion 100 at the left portion adjacent to the sound emitting hole 106 for installing the electroacoustic transducer therein. A display window 110 and a keyboard 112 are provided on the upper side case portion 100. A sound absorbing hole 116 for a microphone 114 is formed on the movable case portion 102.

The space 108 is opened to the atmosphere through a sound emitting hole 118, and it includes therein a waterproof sheet 120 and a ring-shaped rubber pad 122 which is fixed to the waterproof sheet 120 by a fixing means such as adhesive.

Figure 8A:
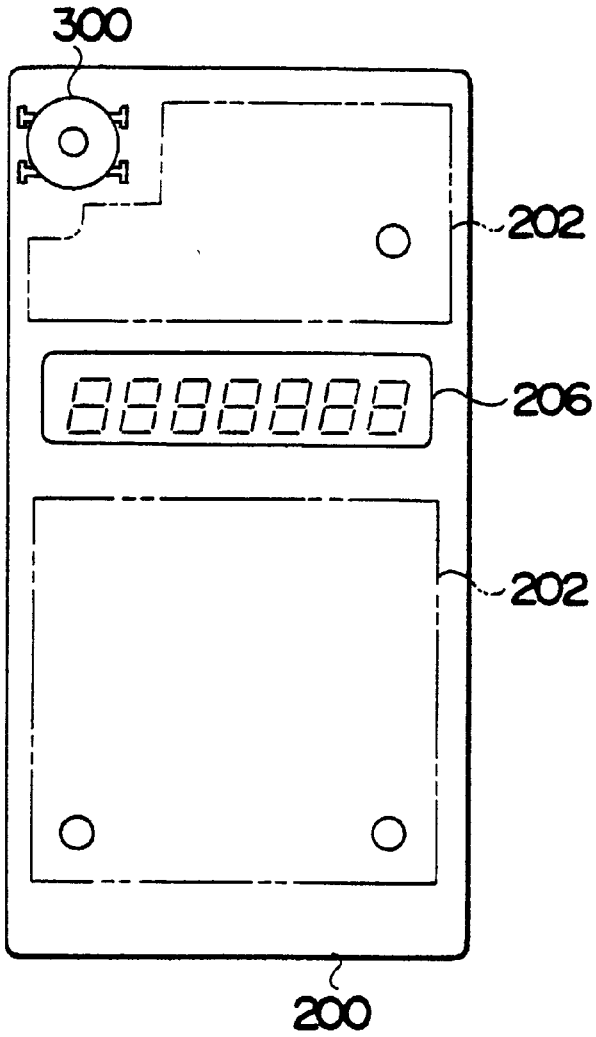
FIG. 8A is a front view showing a board of the portable telephone.
Figure 8B:
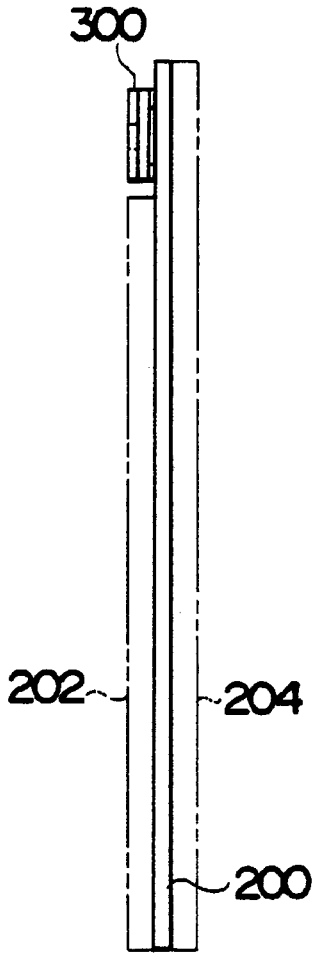
FIG. 8B is a side view showing the board of the portable telephone.

A board 200 as shown in FIGS. 8A and 8B are provided on the back side of the upper side case portion 100. Electronic circuit portions 202 and 204 and a display element 206 for the portable telephone are mounted on the board 200. An electroacoustic transducer 300 is also provided on the board 200 as a sound emitting means for emitting sound such as calling or paging sound at a position corresponding to the rubber pad 122 provided in the space 108 of the upper side case portion 100. The rubber pad 122 is provided as a means for restraining unnecessary oscillation applied to the electroacoustic transducer 300 from the outside, and the waterproof sheet 120 is provided as a means for preventing drops of rain, etc. from entering the electroacoustic transducer 300 from the outside.

Figure 9A:
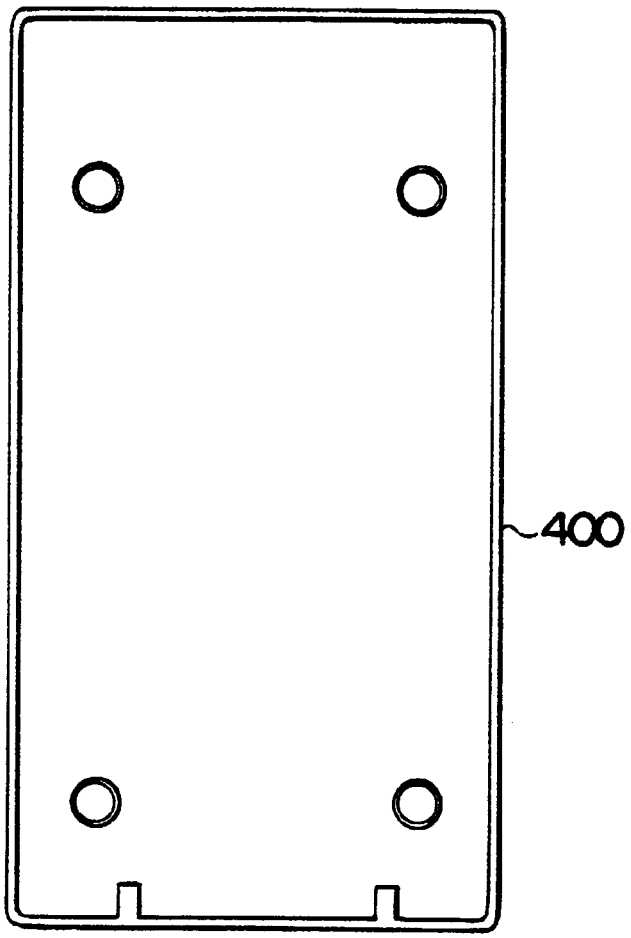
FIG. 9A is a front view of a back side case portion of the portable telephone.
Figure 9B:
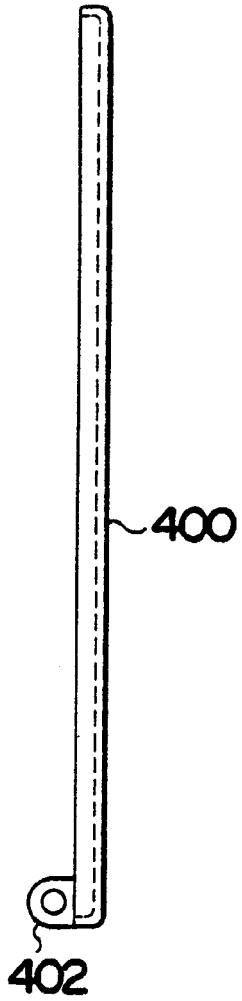
FIG. 9B is a side view of the back side case portion of the portable telephone.

A back side case 400 is provided on the back side of the upper side case portion 100 as shown in FIGS. 9A and 9B for protecting the board 200 from the back side thereof. A hinge piece 402 is provided on the back side case 400 for attaching the movable case portion 102 to the upper side case portion 100 so that the movable case portion 102 can turn about the hinge piece 402.

As evident from the preferred embodiment, the electroacoustic transducer of the present invention can be used as a paging sound generating means of the portable telephone. The electroacoustic transducer of the present invention can be installed in various electronic equipments other than the portable telephone.

Featured items of the electroacoustic transducer will be now described with reference to the following experimental results.

a. Reduction of number of windings of the coil 24.

The electroacoustic transducer is formed by using the coil 24 having the height L1 which is set by reducing the number of windings of the wire 40 by the expansion height of the coil 24. For example, the coil height L1 is reduced from 1.4 mm to 1.25 mm by the expansion height of 0.15 mm in height increased by thermal expansion. If the coil height L1 is reduced by reducing the number of windings of the coil 24, magnetomotive force (ampere turn) developed by the coil 24 is lowered by an amount corresponding to the reduction of the height. However, if the capacity of the resonant chamber 12 is increased, resonance effect can be enhanced, whereby the lowering or reduction of the magnetomotive force can be compensated.

b. Reduction of the coil height L1 using the wire 40 which is reduced in its outer diameter by reducing in thickness the insulating film 44 or fusing film 46 keeping the same diameter of the conductor unchanged.

If such wire 40 is employed, the coil height L1 can be set without reducing the number of windings. This is performed by reducing the number of layer of winding by one layer in the direction of height of the coil 24 and increasing the number of layer of winding by one layer in the outer peripheral direction of the coil 24. In this case, the outer diameter of the coil 24 is not changed. According to the experiment, the coil height L1 can be reduced from 1.4 mm to 1.3 mm, namely, by 0.1 mm. In this case, being different from the case described in the item a, the magnetomotive force developed by the coil 24 is not changed, which dispenses with the adjustment of the resonant chamber 12, etc. and obtains the same sound pressure characteristic as the prior art electroacoustic transducer.

c. Sound pressure characteristic before and after reflow soldering.

In the above a and b cases, there is no problem in sound pressure characteristic. If the coil is heated at the same temperature as the reflow temperature, inferior product is not produced involved in the change of the shape of the coil 24. The expansion height L2 of the coil 24 which employs a polyurethane copper wire of the fusing type as the wire 40 ranges from 10 to 15%, for example, in the coil 24 having the coil height L1=1.4 mm, the expansion height L2 ranges from 140 to 210 $\mu$m and the outer diameter of the coil 24 is scarcely changed.

Further, featured characteristics of the electroacoustic transducer of the present invention will be described with reference to Tables 1 to 6.

Table 1 shows a process capability (Cpk) before and after the reflow soldering. In this experiment, the total magnetic flux value of the annular magnet 26 of the product is roughly classified into 89 to 90 [KMXT] (type I), 90 to 91 [KMXT] (type II), and 91 to 92 [KMXT] (type III), and the Cpk value before and after the reflow soldering is observed . As a result of observation, it is recognized that the Cpk value is remarkably improved in any of the types I to III.

Tables 2A to 2C show sound pressure before and after the reflow soldering. Tables 2B and 2C show frequencies. As a result, it reveals that the coil height L1 is changed before and after the reflow soldering so that the sound pressure characteristic is remarkably improved. Table 2B shows an sound pressure characteristic before the reflow soldering by frequency distribution, and Table 2C shows an sound pressure characteristic after the reflow soldering by frequency distribution. Tables 3A to 3C show change of sound pressure before and after the reflow soldering in Type II. Tables 4A to 4C show change of sound pressure before and after the reflow soldering in Type II. In any type, it is recognized that the sound pressure is changed before and after the reflow soldering so that the sound pressure is remarkably improved.

Tables 5 and 6 show the result of observation of the change of dimensions of the coil 24 before and after the reflow soldering while the number of turns of the coil is fixed. In Table 5, the number of turns of the coil 24 is set to 182 turns, while in Table 6, the number of turns of the coil 24 is set to 190 turns. It is recognized that the average height alone extends remarkably as evident from the comparison of the circumferential height, average height, and outer diameter and average value thereof, maximum value, minimum value and standard deviation thereof before and after the reflow soldering (one time reflow soldering). It is recognized from the change of height and outer diameter of the coil before and after the reflow soldering that only the change of height is remarkable.

As explained above, the following advantages can be obtained according to the present invention:

a. Since the height of the coil can be optimized by the reflow temperature during the reflow soldering, a product represents normal characteristic at the time of manufacture (shipment), but it is changed to the electroacoustic transducer having the optimum characteristic by the heating during the reflow soldering at the time of mounting in the electronic equipment, and the optimum characteristic can be obtained after it is mounted in the electronic equipment.

b. The present invention can surely prevent the defect of the prior art that the characteristic of a product which is optimum at the time of shipment is deteriorated in quality due to the heating during the reflow soldering when the product is mounted in the electronic equipment.

c. It is not necessary to employ a wire which is less deformed thermally for forming the coil, and it is enough to merely administrate the thermal deformation of a general purpose wire. The manufacturing cost of the electroacoustic transducer can be reduced and the quality control of the wire can be easily performed.

d. In case the coil employs a wire which is less deformed thermally, the coil can be miniaturized in anticipation of the thermal expansion and yield can be enhanced.

TABLE 1

| CHANGE OF Cpk VALUE OF SOUND PRESSURE BEFORE AND AFTER REFLOW SOLDERING | | | | |
|---|---|---|---|---|
| | BEFORE OR AFTER REFLOW SOLDERING | TOTAL MAGNETIC FLUX VALUE OF ANNULAR MAGNET (UNIT: KMXT) | | |
| | | 89~90 | 90~91 | 91~92 |
| Cpk (VALUE) | BEFORE REFLOW SOLDERING | 0.7 | 1.1 | 1.2 |
| | AFTER REFLOW SOLDERING | 1.2 | 1.7 | 2.0 |

TABLE 1-continued

| CHANGE OF Cpk VALUE OF SOUND PRESSURE BEFORE AND AFTER REFLOW SOLDERING | | | |
|---|---|---|---|
| BEFORE OR AFTER REFLOW SOLDERING | TOTAL MAGNETIC FLUX VALUE OF ANNULAR MAGNET (UNIT: KMXT) | | |
| | 89~90 | 90~91 | 91~92 |
| AFTER REFLOW SOLDERING | 1.2 | 1.7 | 2.0 |

| CHANGE OF SOUND PRESSURE BEFORE AND AFTER REFLOW SOLDERING (TYPE I) | |
|---|---|
| COIL HEIGHT L1: | 1.3 ± 0.05 mm (BEFORE REFLOW SOLDERING) 1.45 ± 0.05 mm (AFTER REFLOW SOLDERING) |
| TOTAL MAGNETIC FLUX: | 89~90 KMXT |
| INPUT: | SQR 1.5 Vp-p 3200 Hz |
| DISTANCE: | 2 INCH |

TABLE 2A

| | SPL [dB] | |
|---|---|---|
| No. | BEFORE REFLOW SOLDERING | AFTER REFLOW SOLDERING |
| 1 | 97.9 | 99.1 |
| 2 | 97.5 | 98.2 |
| 3 | 97.5 | 99.4 |
| 4 | 98.0 | 98.5 |
| 5 | 97.9 | 98.4 |
| 6 | 99.0 | 99.3 |
| 7 | 98.8 | 98.4 |
| 8 | 97.8 | 98.4 |
| 9 | 98.5 | 98.8 |
| 10 | 98.9 | 99.4 |
| 11 | 99.4 | 99.5 |
| 12 | 98.9 | 98.6 |
| 13 | 98.1 | 98.1 |
| 14 | 97.0 | 97.7 |
| 15 | 98.7 | 98.8 |
| 16 | 98.7 | 99.4 |
| 17 | 98.5 | 99.5 |
| 18 | 98.7 | 99.0 |
| 19 | 98.4 | 99.0 |
| 20 | 98.2 | 98.9 |
| AVE. | 98.3 | 98.8 |
| σn-1 | 0.59 | 0.51 |
| SPEC | 97 min | |
| Cpk | 0.7 | 1.2 |

TABLE 2B

| SOUND PRESSURE DISTRIBUTION BEFORE REFLOW SOLDERING | | |
|---|---|---|
| SPL [dB] | FREQUENCY DISTRIBUTION | N |
| 94 | . | 0 |
| 95 | . | 0 |
| 96 | . | 0 |
| 97 | ++++++ | 6 |
| 98 | ++++++++++++ | 12 |
| 99 | ++ | 2 |

TABLE 2B-continued

| SOUND PRESSURE DISTRIBUTION BEFORE REFLOW SOLDERING | | |
|---|---|---|
| SPL [dB] | FREQUENCY DISTRIBUTION | N |
| 100 | . | 0 |
| 101 | . | 0 |
| 102 | . | 0 |

TABLE 2C

| SOUND PRESSURE DISTRIBUTION AFTER REFLOW SOLDERING | | |
|---|---|---|
| SPL [dB] | FREQUENCY DISTRIBUTION | N |
| 94 | . | 0 |
| 95 | . | 0 |
| 96 | . | 0 |
| 97 | + | 1 |
| 98 | ++++++++++ | 10 |
| 99 | +++++++++ | 9 |
| 100 | . | 0 |
| 101 | . | 0 |
| 102 | . | 0 |

| CHANGE OF SOUND PRESSURE BEFORE AND AFTER REFLOW SOLDERING (TYPE II) | |
|---|---|
| COIL HEIGHT L1: | 1.3 ± 0.05 mm (BEFORE REFLOW SOLDERING) 1.45 ± 0.05 mm (AFTER REFLOW SOLDERING) |
| TOTAL MAGNETIC FLUX: | 90~91 KMXT |
| INPUT: | SQR 1.5 Vp-p 3200 Hz |
| DISTANCE: | 2 INCH |

TABLE 3A

| | SPL [dB] | |
|---|---|---|
| No. | BEFORE REFLOW SOLDERING | AFTER REFLOW SOLDERING |
| 1 | 99.2 | 99.1 |
| 2 | 99.6 | 100.1 |
| 3 | 99.3 | 99.3 |
| 4 | 99.3 | 99.4 |
| 5 | 99.1 | 99.1 |
| 6 | 98.8 | 99.1 |
| 7 | 100.2 | 100.1 |
| 8 | 99.1 | 99.1 |
| 9 | 97.9 | 98.7 |
| 10 | 98.7 | 99.1 |
| 11 | 98.9 | 99.2 |
| 12 | 98.7 | 98.9 |
| 13 | 98.1 | 98.9 |
| 14 | 98.5 | 99.3 |
| 15 | 98.9 | 99.4 |
| 16 | 100.1 | 100.7 |
| 17 | 98.3 | 99.3 |
| 18 | 98.4 | 99.4 |
| 19 | 99.1 | 99.9 |
| 20 | 98.5 | 99.3 |
| AVE. | 99.0 | 99.4 |
| σn-1 | 0.58 | 0.47 |
| SPEC | 97 min | |
| Cpk | 1.1 | 1.7 |

TABLE 3B

| SOUND PRESSURE DISTRIBUTION BEFORE REFLOW SOLDERING | | |
|---|---|---|
| SPL [dB] | FREQUENCY DISTRIBUTION | N |
| 94 | . | 0 |
| 95 | . | 0 |
| 96 | . | 0 |
| 97 | + | 1 |
| 98 | +++++++++ | 9 |
| 99 | ++++++++ | 8 |
| 100 | ++ | 2 |
| 101 | . | 0 |
| 102 | . | 0 |

TABLE 3C

| SOUND PRESSURE DISTRIBUTION AFTER REFLOW SOLDERING | | |
|---|---|---|
| SPL [dB] | FREQUENCY DISTRIBUTION | N |
| 94 | . | 0 |
| 95 | . | 0 |
| 96 | . | 0 |
| 97 | . | 0 |
| 98 | +++ | 3 |
| 99 | ++++++++++++++ | 14 |
| 100 | +++ | 3 |
| 101 | . | 0 |
| 102 | . | 0 |

| CHANGE OF SOUND PRESSURE BEFORE AND AFTER REFLOW SOLDERING (TYPE III) | |
|---|---|
| COIL HEIGHT L1: | 1.3 ± 0.05 mm (BEFORE REFLOW SOLDERING) 1.45 ± 0.05 mm (AFTER REFLOW SOLDERING) |
| TOTAL MAGNETIC FLUX: | 91~92 KMXT |
| INPUT: | SQR 1.5 Vp-p 3200 Hz |
| DISTANCE: | 2 INCH |

TABLE 4A

| | SPL [dB] | |
|---|---|---|
| No. | BEFORE REFLOW SOLDERING | AFTER REFLOW SOLDERING |
| 1 | 99.7 | 99.4 |
| 2 | 99.7 | 99.9 |
| 3 | 100.1 | 100.9 |
| 4 | 99.3 | 99.5 |
| 5 | 99.0 | 99.4 |
| 6 | 99.0 | 99.3 |
| 7 | 99.1 | 100.0 |
| 8 | 98.9 | 99.4 |
| 9 | 98.9 | 99.4 |
| 10 | 98.4 | 99.8 |
| 11 | 98.4 | 99.4 |
| 12 | 98.5 | 99.7 |
| 13 | 98.6 | 99.6 |
| 14 | 98.7 | 99.6 |
| 15 | 98.2 | 99.6 |
| 16 | 98.1 | 99.5 |
| 17 | 98.3 | 98.7 |
| 18 | 99.0 | 100.3 |
| 19 | 98.9 | 99.3 |

TABLE 4A-continued

| No. | SPL [dB] BEFORE REFLOW SOLDERING | SPL [dB] AFTER REFLOW SOLDERING |
|---|---|---|
| 20 | | |
| AVE. | 98.9 | 99.6 |
| σn-1 | 0.52 | 0.44 |
| SPEC | 97 min | |
| Cpk | 1.2 | 2.0 |

TABLE 4B

| SOUND PRESSURE DISTRIBUTION BEFORE REFLOW SOLDERING | | |
|---|---|---|
| SPL [dB] | FREQUENCY DISTRIBUTION | N |
| 94 | . | 0 |
| 95 | . | 0 |
| 96 | . | 0 |
| 97 | | 0 |
| 98 | ++++++++++ | 11 |

TABLE 4B-continued

| SOUND PRESSURE DISTRIBUTION BEFORE REFLOW SOLDERING | | |
|---|---|---|
| SPL [dB] | FREQUENCY DISTRIBUTION | N |
| 99 | +++++++ | 7 |
| 100 | + | 1 |
| 101 | . | 0 |
| 102 | . | 0 |

TABLE 4C

| SOUND PRESSURE DISTRIBUTION AFTER REFLOW SOLDERING | | |
|---|---|---|
| SPL [dB] | FREQUENCY DISTRIBUTION | N |
| 94 | . | 0 |
| 95 | . | 0 |
| 96 | . | 0 |
| 97 | . | 0 |
| 98 | + | 1 |
| 99 | +++++++++++++++ | 15 |
| 100 | +++ | 3 |
| 101 | . | 0 |
| 102 | . | 0 |

TABLE 5

EVALUATION OF REFLOW SOLDERING (NUMBER OF TURN: 182T)

Unit: mm

| | BEFORE REFLOW SOLDERING | | | | | AFTER REFLOW SOLDERING (AFTER ONE TIME REFLOW SOLDERING) | | | | | BEFORE AND AFTER REFLOW SOLDERING | |
|---|---|---|---|---|---|---|---|---|---|---|---|---|
| | CIRCUMFERENCE DIRECTIONAL HEIGHT | | | AVERAGE HEIGHT | OUTER DIAMETER | CIRCUMFERENCE DIRECTIONAL HEIGHT | | | AVERAGE HEIGHT | OUTER DIAMETER | CHANGE OF HEIGHT | CHANGE OF OUTER DIAMETER |
| 1 | 1.305 | 1.309 | 1.307 | 1.307 | 3.639 | 1.409 | 1.403 | 1.446 | 1.419 | 3.668 | 0.112 | 0.029 |
| 2 | 1.307 | 1.308 | 1.304 | 1.306 | 3.653 | 1.418 | 1.428 | 1.433 | 1.426 | 3.661 | 0.120 | 0.008 |
| 3 | 1.306 | 1.312 | 1.308 | 1.309 | 3.671 | 1.431 | 1.435 | 1.416 | 1.427 | 3.693 | 0.119 | 0.022 |
| 4 | 1.305 | 1.302 | 1.307 | 1.305 | 3.772 | 1.407 | 1.406 | 1.421 | 1.411 | 3.783 | 0.107 | 0.013 |
| 5 | 1.304 | 1.307 | 1.306 | 1.306 | 3.655 | 1.477 | 1.459 | 1.467 | 1.468 | 3.647 | 0.162 | −0.008 |
| 6 | 1.302 | 1.300 | 1.307 | 1.303 | 3.658 | 1.494 | 1.518 | 1.529 | 1.514 | 3.694 | 0.211 | 0.036 |
| 7 | 1.305 | 1.304 | 1.308 | 1.306 | 3.752 | 1.453 | 1.447 | 1.464 | 1.455 | 3.846 | 0.149 | 0.094 |
| 8 | 1.307 | 1.311 | 1.308 | 1.309 | 3.647 | 1.480 | 1.518 | 1.511 | 1.503 | 3.656 | 0.194 | 0.009 |
| 9 | 1.303 | 1.304 | 1.308 | 1.305 | 3.678 | 1.397 | 1.406 | 1.422 | 1.408 | 3.650 | 0.103 | −0.028 |
| 10 | 1.308 | 1.306 | 1.305 | 1.306 | 3.693 | 1.408 | 1.428 | 1.423 | 1.420 | 3.778 | 0.113 | 0.085 |
| 11 | 1.305 | 1.303 | 1.309 | 1.306 | 3.662 | 1.454 | 1.467 | 1.454 | 1.458 | 3.708 | 0.153 | 0.046 |
| 12 | 1.306 | 1.298 | 1.306 | 1.303 | 3.661 | 1.447 | 1.440 | 1.423 | 1.437 | 3.682 | 0.133 | 0.021 |
| 13 | 1.303 | 1.308 | 1.307 | 1.306 | 3.678 | 1.441 | 1.449 | 1.491 | 1.460 | 3.704 | 0.154 | 0.026 |
| 14 | 1.310 | 1.302 | 1.309 | 1.307 | 3.673 | 1.436 | 1.433 | 1.466 | 1.445 | 3.697 | 0.138 | 0.024 |
| 15 | 1.307 | 1.304 | 1.301 | 1.304 | 3.769 | 1.415 | 1.414 | 1.443 | 1.424 | 3.772 | 0.120 | 0.003 |
| 16 | 1.305 | 1.308 | 1.309 | 1.307 | 3.672 | 1.379 | 1.378 | 1.397 | 1.385 | 3.724 | 0.077 | 0.052 |
| 17 | 1.306 | 1.311 | 1.305 | 1.307 | 3.660 | 1.384 | 1.388 | 1.401 | 1.391 | 3.706 | 0.084 | 0.046 |
| 18 | 1.307 | 1.307 | 1.305 | 1.306 | 3.656 | 1.406 | 1.420 | 1.439 | 1.422 | 3.706 | 0.115 | 0.050 |
| 19 | 1.306 | 1.304 | 1.307 | 1.306 | 3.765 | 1.431 | 1.478 | 1.457 | 1.455 | 3.840 | 0.150 | 0.075 |
| 20 | 1.305 | 1.310 | 1.308 | 1.308 | 3.763 | 1.421 | 1.415 | 1.413 | 1.416 | 3.830 | 0.109 | 0.067 |
| AVERAGE VALUE | 1.306 | 1.306 | 1.307 | 1.306 | 3.689 | 1.429 | 1.437 | 1.446 | 1.437 | 3.722 | 0.131 | 0.034 |
| MAXIMUM VALUE | 1.310 | 1.312 | 1.309 | 1.309 | 3.772 | 1.494 | 1.518 | 1.529 | 1.514 | 3.846 | 0.211 | 0.094 |
| MINIMUM VALUE | 1.302 | 1.298 | 1.301 | 1.303 | 3.639 | 1.379 | 1.378 | 1.397 | 1.385 | 3.847 | 0.077 | −0.028 |
| STANDARD DEVIATION | 0.002 | 0.004 | 0.002 | 0.002 | 0.045 | 0.031 | 0.037 | 0.034 | 0.032 | 0.062 | 0.033 | 0.031 |

TABLE 6

EVALUATION OF REFLOW SOLDERING (NUMBER OF TURN: 190T)

Unit: mm

| | BEFORE REFLOW SOLDERING | | | | | AFTER REFLOW SOLDERING (AFTER ONE TIME REFLOW SOLDERING) | | | | | BEFORE AND AFTER REFLOW SOLDERING | |
|---|---|---|---|---|---|---|---|---|---|---|---|---|
| | CIRCUMFERENCE DIRECTIONAL HEIGHT | | | AVERAGE HEIGHT | OUTER DIAMETER | CIRCUMFERENCE DIRECTIONAL HEIGHT | | | AVERAGE HEIGHT | OUTER DIAMETER | CHANGE OF HEIGHT | CHANGE OF OUTER DIAMETER |
| 1 | 1.309 | 1.310 | 1.309 | 1.309 | 3.903 | 1.457 | 1.477 | 1.490 | 1.475 | 3.896 | 0.165 | −0.007 |
| 2 | 1.308 | 1.307 | 1.306 | 1.307 | 3.906 | 1.383 | 1.435 | 1.455 | 1.424 | 3.913 | 0.117 | 0.007 |
| 3 | 1.308 | 1.308 | 1.307 | 1.308 | 3.743 | 1.426 | 1.439 | 1.467 | 1.444 | 3.867 | 0.136 | 0.124 |
| 4 | 1.306 | 1.305 | 1.308 | 1.306 | 3.802 | 1.386 | 1.416 | 1.441 | 1.414 | 3.868 | 0.108 | 0.066 |
| 5 | 1.307 | 1.305 | 1.304 | 1.305 | 3.811 | 1.455 | 1.454 | 1.429 | 1.446 | 3.810 | 0.141 | −0.001 |
| 6 | 1.310 | 1.302 | 1.306 | 1.306 | 3.874 | 1.479 | 1.480 | 1.468 | 1.476 | 3.883 | 0.170 | 0.009 |
| 7 | 1.306 | 1.302 | 1.302 | 1.303 | 3.810 | 1.407 | 1.407 | 1.404 | 1.406 | 3.857 | 0.103 | 0.047 |
| 8 | 1.308 | 1.309 | 1.308 | 1.308 | 3.951 | 1.400 | 1.397 | 1.401 | 1.399 | 3.933 | 0.091 | 0.018 |
| 9 | 1.308 | 1.299 | 1.310 | 1.306 | 3.818 | 1.378 | 1.399 | 1.419 | 1.399 | 3.862 | 0.093 | 0.044 |
| 10 | 1.309 | 1.305 | 1.309 | 1.308 | 3.745 | 1.407 | 1.412 | 1.416 | 1.412 | 3.772 | 0.104 | 0.027 |
| 11 | 1.306 | 1.308 | 1.307 | 1.307 | 3.781 | 1.431 | 1.424 | 1.492 | 1.449 | 3.845 | 0.142 | 0.064 |
| 12 | 1.307 | 1.308 | 1.309 | 1.308 | 3.908 | 1.391 | 1.397 | 1.425 | 1.404 | 3.928 | 0.096 | 0.020 |
| 13 | 1.306 | 1.308 | 1.307 | 1.307 | 3.892 | 1.391 | 1.405 | 1.435 | 1.410 | 3.902 | 0.103 | 0.010 |
| 14 | 1.310 | 1.303 | 1.309 | 1.307 | 3.800 | 1.366 | 1.398 | 1.476 | 1.413 | 3.877 | 0.106 | 0.077 |
| 15 | 1.308 | 1.307 | 1.307 | 1.307 | 3.796 | 1.366 | 1.458 | 1.511 | 1.445 | 3.821 | 0.138 | 0.025 |
| 16 | 1.308 | 1.305 | 1.307 | 1.307 | 3.760 | 1.400 | 1.443 | 1.471 | 1.438 | 3.758 | 0.131 | −0.002 |
| 17 | 1.309 | 1.301 | 1.306 | 1.305 | 3.839 | 1.381 | 1.423 | 1.453 | 1.419 | 3.928 | 0.114 | 0.089 |
| 18 | 1.307 | 1.306 | 1.306 | 1.306 | 3.788 | 1.425 | 1.439 | 1.442 | 1.435 | 3.862 | 0.129 | 0.074 |
| 19 | 1.307 | 1.307 | 1.307 | 1.307 | 3.748 | 1.411 | 1.423 | 1.432 | 1.422 | 3.787 | 0.115 | 0.039 |
| 20 | 1.310 | 1.298 | 1.307 | 1.305 | 3.816 | 1.462 | 1.467 | 1.423 | 1.451 | 3.873 | 0.146 | 0.057 |
| AVERAGE VALUE | 1.308 | 1.305 | 1.307 | 1.307 | 3.825 | 1.410 | 1.430 | 1.448 | 1.429 | 3.871 | 0.122 | 0.038 |
| MAXIMUM VALUE | 1.310 | 1.310 | 1.310 | 1.309 | 3.951 | 1.479 | 1.480 | 1.511 | 1.476 | 3.913 | 0.170 | 0.124 |
| MINIMUM VALUE | 1.306 | 1.298 | 1.302 | 1.303 | 3.743 | 1.366 | 1.397 | 1.401 | 1.399 | 3.810 | 0.091 | −0.007 |
| STANDARD DEVIATION | 0.001 | 0.003 | 0.002 | 0.001 | 0.060 | 0.032 | 0.026 | 0.030 | 0.023 | 0.035 | 0.023 | 0.050 |

What is claimed is:

1. A method for manufacturing an electroacoustic transducer and then mounting the manufactured transducer on a printed circuit board by reflow soldering, said method comprising the steps:

positioning a plate base made of magnetic material;

positioning a core, made of magnetic material, upright on an upper surface of said base, said core having a predetermined height;

positioning a diaphragm with a gap defined between the top of the core and the diaphragm;

forming a wound coil around a periphery of said core and positioning a magnet around said coil with a space retained between an outer wall surface of said coil and an inner wall surface of said magnet;

said coil having a body formed by a wire covered with a fusing film and wound around said core in strata from the upper surface of said base toward a top of said core, said fusing film made of a thermoplastic resin having a preselected coefficient of thermal expansion, wherein said coil is formed with an initial height that is substantially lower than said predetermined height of said core while said body of said coil includes the number of windings for developing predetermined magnetic force before the transducer to be manufactured is subjected to reflow soldering, the body of said coil further being wound around said core for exposing the top of said core, thereby producing the transducer;

connecting the transducer to a printed circuit board by reflow soldering;

said reflow soldering causing the coil to expand axially toward the top of said core by a preselected amount due to thermal expansion of said thermoplastic resin after the transducer is reflow soldered to achieve an optimal coil height;

wherein the preselected amount of coil height extension after reflow soldering results in an optimized final coil height not exceeding said predetermined height of the core.

2. The method according to claim 1, wherein the coil is brought into contact with the upper base surface; and the predetermined height of the core remains slightly higher than the final coil height after reflow soldering.

3. The method as set forth in claim 1 wherein the transducer is connected to a circuit of electronic equipment, and further wherein the transducer is employed as a sound emitting means.

4. The method set forth in claim 1 wherein the transducer is connected to a circuit of a telephone, and further wherein the transducer is employed as a sound emitting means.

* * * * *